United States Patent [19]

Parkes

[11] 4,174,941

[45] Nov. 20, 1979

[54] SLEEVE AND DAMPER FOR OIL BURNER

[75] Inventor: Ralph C. Parkes, Rydal, Pa.

[73] Assignee: The National Drying Machinery Corp. of America, Philadelphia, Pa.

[21] Appl. No.: 857,903

[22] Filed: Dec. 6, 1977

[51] Int. Cl.[2] ..... F23N 5/00; F23D 15/02

[52] U.S. Cl. ..... 431/3; 431/19; 431/62; 431/158; 431/351; 431/353

[58] Field of Search ..... 431/2, 3, 19, 62, 158, 431/350, 351, 352, 353

[56] References Cited

U.S. PATENT DOCUMENTS

| | | | |
|---|---|---|---|
| 1,914,133 | 6/1933 | Kerr | 431/62 |
| 1,923,330 | 8/1933 | Sallee | 431/158 |
| 3,156,454 | 11/1964 | Flynn | 431/158 |
| 3,786,799 | 1/1974 | Cox | 431/19 X |
| 4,062,343 | 12/1977 | Spielman | 431/353 |

FOREIGN PATENT DOCUMENTS

| | | | |
|---|---|---|---|
| 2321664 | 3/1977 | France | 431/353 |

*Primary Examiner*—John J. Camby

*Attorney, Agent, or Firm*—Weiser, Stapler & Spivak

[57] ABSTRACT

A sleeve and damper to increase the efficiency of oil burner performance designed to substantially enclose the flame. The sleeve is heated by the flame to a temperature sufficiently high to assure automatic ignition of unburned hydrocarbons that may result from incomplete combustion of the fuel oil. By controlling the damper operation in conjunction with an adjustable induction air apparatus, unburned hydrocarbons which would ordinarily result are completely oxidized. The resulting completeness of combustion permits the use of oil as a fuel to heat ovens without imparting any odor or taste to the food products being processed therewithin.

19 Claims, 5 Drawing Figures

SLEEVE AND DAMPER FOR OIL BURNER

BACKGROUND OF THE INVENTION

This invention pertains to a sleeve and damper assembly adapted for use in connection with an oil burner to maintain the interior of the assembly at a temperature sufficient to assure automatic ignition of unburned hydrocarbons in a manner to provide complete combustion of the fuel.

Conventional industrial ovens are generally fueled by either oil or gas and sometimes by a combination thereof. In the food preparation industry, in particular in food drying and baking procedures, the use of fuel oil has in the past been found to be unacceptable due to the fact that fuel oil can not be burned in a complete, clean manner. The fuel oil not completely ignited by conventional oil burners generally leaves a residue of particles of unburned oil and hydrocarbons resulting from the incomplete combustion within the oven area. This residue adversely effects food products placed within the oven by imparting an undesirable oily odor or taste to the food products. Such an occurrence is clearly not acceptable in the food industry. As a result, food processors have been forced to rely almost exclusively upon the cleaner burning fuel, natural or manufactured gas.

Recently, reliance upon gas as a fuel has become quite costly and economically dangerous. Prices of natural and manufactured gas have increased dramatically, This results in increased fuel costs which must be borne by the consumer through higher retail prices. More importantly, the problem has been further complicated by recent realizations that natural gas as a resource is becomingly increasingly scarce. This fact has been dramatically illustrated during the past few winters wherein many factories that were designed to employ gas either for heating or for various industrial processes were forced to completely close as a result of their inability to obtain adequate supplies of natural gas. The problem is accentuated by the fact that many homes utilize gas as the primary fuel for house heating purposes. In times of gas shortage, when the competition for available supplies is keen, the heating of houses has natural priority over all industrial and commercial uses of gaseous fuels. In order to prevent complete shut down of bakeries and other food processing establishments in times of gaseous fuel emergency, the shortages have created a real need to design a burner capable of cleanly burning fuel oil in order to permit use of that fuel by the food industry.

The present invention serves to satisfy this need. This is accomplished by providing an environment incorporating continuous supplemental fuel oil burning capability by maintaining a temperature at the burner above that required for the automatic ignition of fuel oil. As a result, the contaminants resulting from incomplete combustion of fuel oil normally associated with conventional burners, can be eliminated to provide a clean oven in which food may be heated and processed without oil contamination.

SUMMARY OF THE INVENTION

This invention relates to a sleeve and damper assembly used in connection with an oil burner of conventional design, adapted to enclose the flame produced by the oil burner. The temperature within the sleeve is maintained sufficiently high to assure the automatic ignition of fuel oil. In this manner, contaminants in the form of unburned oil particles and hydrocarbons resulting from the incomplete burning of fuel oil are burned within the sleeve to greatly increase the degree of completeness of combustion. This results in a clean environment in which products to be heated may be placed without being contaminated.

This complete combustion capability is provided by a sleeve, one end of which is associated with an oil burner to receive therewithin the flame from the burner. The other end of the sleeve is provided with a pivoting type damper that is responsive to internal pressure changes to maintain optimum burning conditions. Also provided as part of the sleeve is an adjustable air inlet means which may be a sliding collar placed over the air inlet to regulate the quantity of induction air entering the sleeve.

Prior to igniting the oil burner, preferably the sleeve is preheated to a temperature above that required for automatic ignition of fuel oil. This may be accomplished by utilizing the gas burning apparatus of a conventional combination gas/oil type burner. Upon heating the sleeve to operating temperature, that is, to a temperature above that required for automatic ignition, the fuel burned is then switched from gas to fuel oil.

A great percentage of the fuel oil burned is ignited in conventional manner by the flame of the oil burner. Any unburned hydrocarbons resulting from incomplete combustion in the initial burning are then automatically ignited as a result of the high temperature maintained within the interior chamber defined by the walls of the sleeve. It is contemplated that the combustion of the gaseous fuel will heat the walls of the sleeve to a glowing condition to thereby provide automatic ignition of all unburned hydrocarbons when the fuel is switched to oil. Thus complete burning of the fuel oil used is assured.

A pivoting type damper is provided at the open end of the sleeve to substantially enclose the central chamber and to provide a restricted environment for the flame contained therein. This enclosure serves to maintain the internal temperature of the chamber sufficiently high to assure automatic ignition of unburned particles of fuel oil. In order to accommodate variable conditions caused by burning rate, temperature, primary air, etc., the damper is adapted to pivot in an automatic manner to compensate for such changes. At slow firing rates the damper pivots to a substantially closed position thereby to enclose the sleeve and retain heat produced. In this manner, the internal temperature within the sleeve is maintained sufficiently high to assure automatic ignition of unburned hydrocarbons. Upon high firing the damper automatically pivots to a position of greater opening, thereby permitting pressure to escape. In this manner, the temperature within the sleeve is maintained at a level sufficient to assure automatic ignition yet not so high as to cause damage to either the sleeve or the oven.

The ignition and combustion of fuel oil at the burner results in the production of gases which must be permitted to escape from within the sleeve central chamber. Upon high firing, the gases escape as the damper pivots open. For low firing rates, when the internal pressures generated are insufficient to pivot the damper, escape is provided either by opening the damper slightly by employing an adjustable stop or by providing an opening in the damper body through which the gases may pass.

The pivoting damper is provided with a rod upon which a counterweight is adjustably mounted to compensate automatically the internal pressures. The temperature and pressure maintained within the sleeve central chamber are adjustable by moving the counterweight axially along the rod to thereby regulate the amount of opening or closing of the pivoting damper. Adjustable air inlets are provided at the base of the sleeve to further assist in the efficient combustion of fuel oil by providing a capability for adjusting the quantity of induced air necessary for complete combustion.

It is therefore an object of this invention to provide a novel sleeve and damper for use with an oil burner to assure complete combustion of the fuel.

It is another object of this invention to provide a clean firing fuel oil burner assembly capable of use by the food industry in the preparation of foods without imparting in those foods an undesirable odor and taste of unburned hydrocarbons.

It is another object of this invention to provide a sleeve defining a chamber, adapted to surround the flame of an oil burner, to maintain a temperature sufficiently high to assure automatic ignition of all fuel oil burned by the oil burner.

It is still another object of this invention to provide a novel sleeve to enclose the flame from an oil burner, the sleeve including an adjustable air inlet which is capable of regulating the amount of induced air to permit adjustment of the flame for most efficient combustion.

It is another object of the present invention to provide a novel sleeve and damper for an oil burner that is simple in design, inexpensive in manufacture and trouble free when in use.

These objects and others will become apparent to those skilled in the art from the following disclosure of the preferred embodiment of the invention taken in conjunction with the drawings provided in which like reference characters refer to similar parts throughout the several views.

DESCRIPTION OF THE PREFERRED EMBODIMENT OF THE INVENTION

Figure 1:
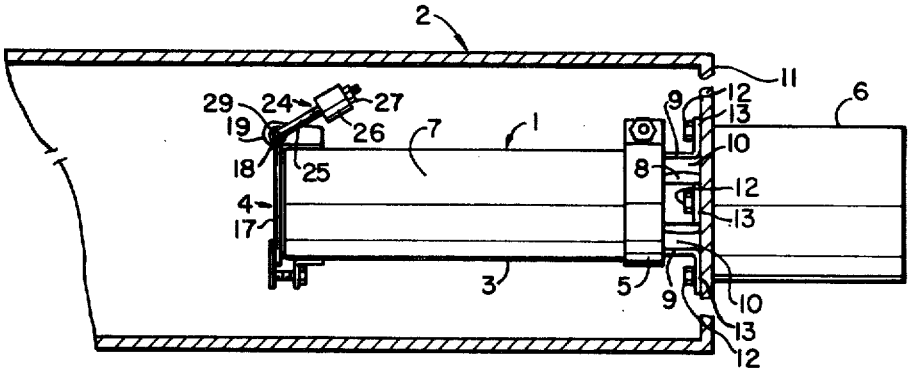
FIG. 1 is an elevational view, partly in section, and partly broken away, of an oil burner and sleeve assembly mounted within an oven.

Although specific terms are used in the following description for the sake of clarity, these terms are intended to refer only to the particular structure of my invention selected for illustration in the drawings, and are not intended to define or limit the scope of the invention.

Referring now to the drawings, there is illustrated in FIG. 1 an oil burner assembly generally designated 1 mounted in an oven generally designated 2. The oil burner assembly 1 generally comprises a hollow, cylindrical sleeve 3, a pivoting damper assembly 4, an adjustable air inlet collar 5 and a conventional combination gas and oil burner 6.

Figure 2:
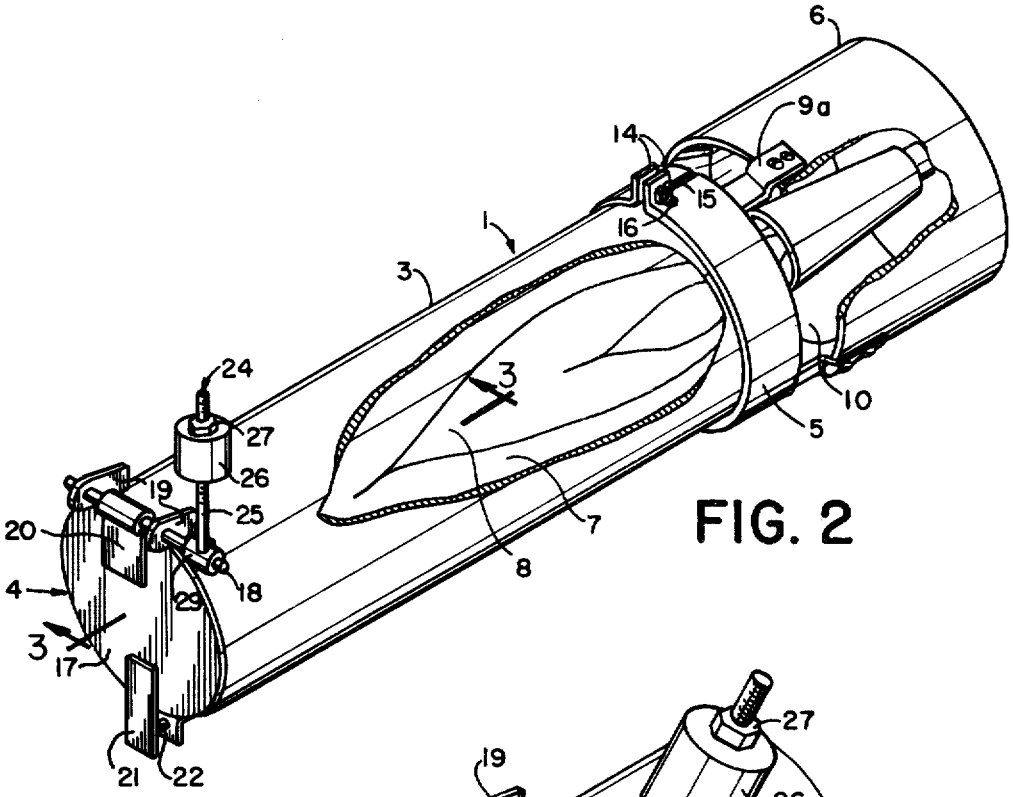
FIG. 2 is an enlarged perspective view of an oil burner equipped with a sleeve, pivoting damper and adjustable air inlet, and partly broken away.

The sleeve 3 defines a central interior chamber 7 into which the flame 8 from the burner 6 is directed to fire centrally along the longitudinal axis of the sleeve 3, as is illustrated in FIG. 2. The sleeve 3 may be formed of any material suitable for the retention of heat such as sheet metal of adequate gauge for the usage and may be any shape which is suitable to contain the flame 8 within the central chamber 7 for efficient combustion, preferably of hollow, cylindrical configuration.

The sleeve 3 is preferably spaced from the oil burner 6 and the oven wall 11 by mounting straps 9 (FIG. 1) or 9*a* (FIG. 2). The mounting straps 9, or 9*a* define air inlets 10 between the oven wall 11 and the inlet end of the sleeve 3 which are of a size appropriate to assure efficient burning of fuel in the manner hereinafter more fully described. The mounting straps 9, secure the sleeve 3 to the oven wall 11 by conventional binding means such bolts 12 passing through mounting flanges 13 or any other appropriate construction. The mounting straps 9, 9*a* are secured at their other ends to the sleeve 3 in conventional manner such as by spot welding to allow the adjustable air inlet collar 5 to slide over the mounting straps 9, 9*a* for induced air adjustment. In FIG. 2, the mounting straps 9*a* are illustrated as bolted directly to a portion of the burner 6.

Figure 4:
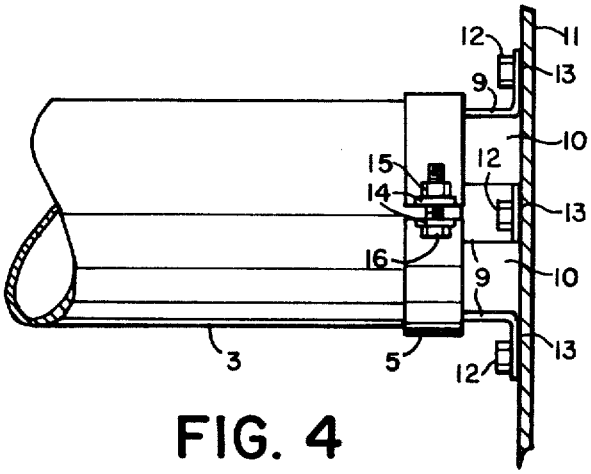
FIG. 4 is an enlarged, partial, top plan view of the adjustable air inlet of the sleeve of FIG. 1.

The adjustable air inlet collar 5 is adapted to slidingly adjust the openings of the air inlets 10 to regulate the quantity of induced air entering the sleeve central chamber 7. As best illustrated in FIGS. 1, 2 and 4, the adjustment of the collar 5 allows the operator to regulate the air mixture provided to the central chamber 7 to assure that the flame 8 of the conventional oil/gas burner 6 burns most efficiently.

The adjustable air inlet collar 5 can be provided with retention flanges 14 through which a nut 15 equipped with a bolt 16 may be threaded. Upon adjusting the position of the collar to obtain the desired fuel to air mixture for complete combustion, the adjustable air inlet collar 5 may be retained in place by tightening the nut 15 and bolt 16 to pull the flanges 14 together to hold the collar 5 in a fixed, adjusted position.

Figure 3:
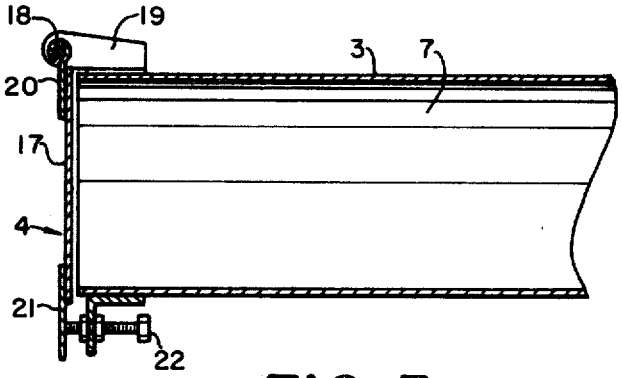
FIG. 3 is a partial cross-sectional view taken along line 3—3 of FIG. 2.

Referring now to FIGS. 1, 2 and 3, the remote end of the sleeve 3 furthest from the oven wall 11 and oil-gas burner 6 is provided with the pivoting damper assembly 4. This assembly generally comprises a damper 17 which is adapted to hang by a connected strap 20 secured to the transverse rod 18. The rod 18 is pivotally retained to the top of the sleeve 3 by a pair of spaced, bearing supports 19. The damper 17 is preferably of a size which overfits completely the opening at the remote end of the sleeve 3. As illustrated in FIGS. 1, 2 and 3, the damper assembly 4 includes a pressure releasing means to maintain a continuously open, restricted escape path for gases from within the central chamber 7. One such gas releasing means comprises a stop 21 which is affixed to the damper 17 and depends downwardly from the bottom periphery thereof and a stop bolt 22, the latter being adjustably attached to the sleeve 3. The damper connected stop 21, is adapted to space part of the damper 17 away from the end of the sleeve 3 to assure a minimum gas escape path at all times. The distance between the damper 17 and the sleeve 3 can be adjusted by the stop bolt 22 to either increase or decrease the size of the escape path opening, depending upon operating conditions.

Figure 5:
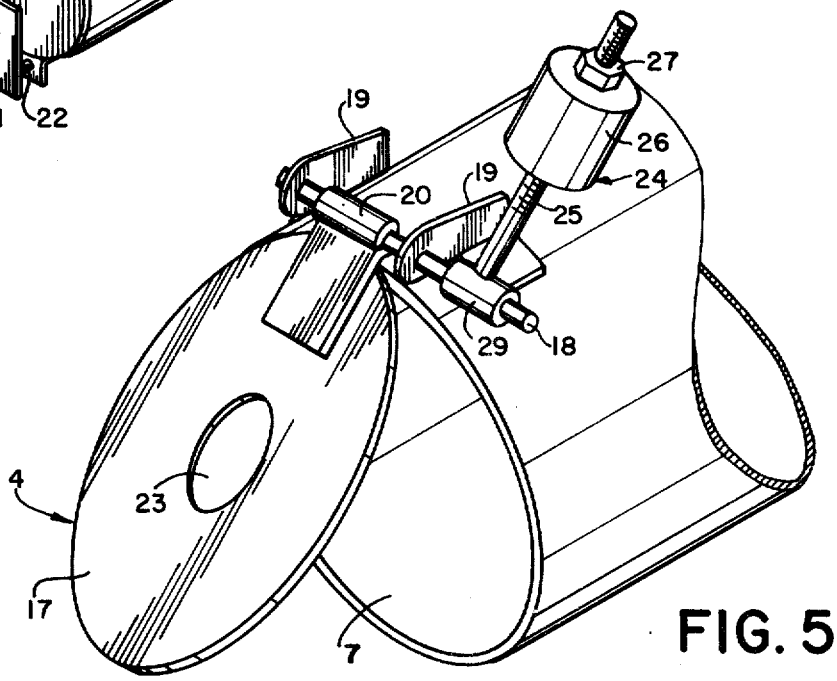
FIG. 5 is an enlarged, partial perspective view of a modified embodiment of the pivoting damper assembly.

An alternative gas releasing means that may be utilized in connection with this invention is illustrated in FIG. 5. In this embodiment, a hole or central opening 23 is cut in the damper 17*a* to allow gases to escape from the central chamber 7 through the opening at all times. Adjustment of this gas releasing means may be provided by varying the size of the hole 23 or by partially covering the hole 23 with a cover (not shown).

Another embodiment of a gas releasing means may be provided by utlizing a damper 17 of a smaller diameter than the diameter of the remote end opening of the sleeve 3. Gases would then be permitted to escape from the central chamber 7 through the annular opening between the damper 17 and the sleeve 3. Adjustment of the effective size of the gas releasing means would be possible.

An adjustable counterweight assembly 24 comprising a balancing rod 25, a counterweight 26 and a locking bolt 27 is provided as part of the pivoting damper assembly 4 to permit adjustment of the response of the damper 17 for varying firing rates. By moving the counterweight 26 along the balancing rod 25, for example, by rotating the counterweight about a threaded rod, the weight of the damper 17 may be compensated to permit adjustment of the pressure of gases required to open the damper 18. Adjustment means may be provided by threading the balancing rod 25 and the counterbalance 26, the rotated position of the counterweight 26 being lockable in its desired position by the locking bolt 27. The adjustable counterweight assembly 24 may be attached to the pivoting damper assembly 4 at the end of the pivoting rod 18 by means of a collar formed in the connecting strap 20 to connect the two assemblies.

In operation, to bring a cold oven 2 up to its operating temperature without permeating the interior with the smell of fuel oil, the sleeve 3 is initially heated to a temperature which permits the automatic ignition of fuel oil by using gas as the fuel for the burner 6. Upon completion of this initial warm up phase wherein the sleeve is heated sufficiently to assure automatic fuel ignition, the gas burner is switched off and the oil burner 6 is switched on, thereby using only a minimum of gaseous gas to fire the oven 2.

Upon the firing of the oil burner 6, the flame 8 enters the central chamber 7 along its longitudinal axis. The flame 8 conventionally carries with it unburned hydrocarbons which ordinarily, if not burned, would contaminate the oven interior and its contents. The efficiency of the flame 8 may be adjusted by sliding the adjustable air inlet collar 5 over the air inlets 10 to adjust the quantity of induced air to maximize combustion. By regulating the oxygen reaching the central chamber 7, the flame 8 may be adjusted to burn cleaner than would be the case with a conventional oil burner that was not so equipped. Upon obtaining the optimum setting, the adjustable air inlet collar 5 may be secured in position to maintain the desired setting.

The sleeve 3 is heated, either by gas or oil operation of the burner 6 to maintain the temperature within the central chamber 7 above that required for automatic ignition of fuel oil. By maintaining the central chamber 7 at that elevated temperature, unburned oil particles are automatically ignited and burned, thereby removing those contaminants from the central chamber 7 and preventing their entry into the interior of the oven 2. This assures a clean environment in which foods may be placed for processing.

The damper 17 is utilized to retain the heat of the flame 8 within the central chamber 7. This assures that the temperature of the central chamber 7 will remain above that required for the automatic ignition of the unburned fuel oil particles. The damper 17 pivots to permit it to open, thereby preventing the temperature within the central chamber 7 from rising above a safe level. As the temperature within the central chamber 7 rises, the pressure created by the combustion of gases forces the damper 17 open to permit escape of the gases. This simultaneously serves to prevent the build up of excess temperature within the central chamber 7.

Adjustment of the point at which the damper 17 opens, as well as the rate at which it opens, is provided by the adjustable counterweight assembly 24. Varying the longitudinal position of the counterweight 26 along the balancing rod 25 varies the pressure required to open the damper 17, thereby regulating the temperature of the central chamber 7. A desired, predetermined setting may then be maintained by tightening the locking bolt 27 on the counterweight 26.

At lower temperatures, the damper 17 will remain substantially closed due to the low pressures present within the central chamber 7. To provide a constant path through which gases can escape and to maintain the flame 8 at its most efficient firing point, a continuous pressure releasing means is provided. This may be accomplished by using a stop 21 and stop bolt 22 as illustrated in FIG. 3, a central hole 23 provided in the damper 17 as illustrated in FIG. 5, or by forming the damper 17 of smaller diameter than the opening at the remote end of the sleeve 3 to define an annular opening. Adjustment of the minimum rate at which such gases may escape is provided by adjusting the stop bolt 22 or varying the size of the hole 23 or damper 17, respectively.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention is not limited by the foregoing specification, but only by the claims annexed hereto.

What is claimed is:

1. A heat retaining enclosure for an oil burner comprising
   - a hollow sleeve defining an enclosed chamber and having a connected end and a remote end,
   - the connected end being adapted to permit the oil burner to direct a flame into the enclosed chamber; and
   - a damper connected to the remote end of the sleeve, said damper being adapted to pivot relative the sleeve,
     - the said damper being spaced from the burner by a distance substantially equal to the length of the sleeve;
   - whereby increased temperatures can be maintained in the enclosed chamber to assure complete combustion of hydrocarbons not burned by the oil burner.

2. The enclosure of claim 1 wherein the sleeve is hollow cylindrical in configuration.

3. The enclosure of claim 1 wherein the connected end of the sleeve is adapted for connection to a wall and wherein the connected end and the wall define an air inlet into the enclosed chamber therebetween.

4. The enclosure of claim 3 and means to adjust the size of the air inlet.

5. A heat retaining enclosure for an oil burner comprising a hollow sleeve defining an enclosed chamber and having a connected end and a remote end, the connected end being adapted to permit the oil burner to direct a flame into the enclosed chamber, the connected end of the sleeve being adapted for connection to a wall wherein the connected end and the wall define an air inlet into the enclosed chamber therebetween;

means to adjust the size of the air inlet to adjust the quantity of air entering the enclosed chamber, the means to adjust comprising a collar, said collar being adapted to slide over the air inlet to cover parts of the said air inlet; and a damper connected to the remote end of the sleeve, said damper being adapted to pivot relative the sleeve;

whereby increased temperatures can be maintained in the enclosed chamber to assure complete combustion of hydrocarbons not burned by the oil burner.

6. The enclosure of claim 5 wherein the adjustable means comprises means to secure the collar in any adjusted position.

7. The enclosure of claim 5 and a plurality of straps secured to the sleeve and to the wall to retain the sleeve in spaced relation to the wall.

8. A heat retaining enclosure for an oil burner comprising a hollow sleeve defining an enclosed chamber and having a connected end and a remote end, the connected end being adapted to permit the oil burner to direct a flame into the enclosed chamber; and a damper connected to the remote end of the sleeve, said damper being adapted to pivot relative the sleeve, the damper being provided with a pressure releasing means to automatically prevent excess pressure within the chamber;

whereby increased temperatures can be maintained in the enclosed chamber to assure complete combustion of hydrocarbons not burned by the oil burner.

9. The enclosure of claim 8 wherein the pressure releasing means comprises an adjustable stop.

10. The enclosure of claim 9 wherein the adjustable stop is adapted to space a part of the damper from the remote end of the sleeve.

11. The enclosure of claim 8 wherein the pressure releasing means comprises an opening cut in the damper.

12. A heat retaining enclosure for an oil burner comprising a hollow sleeve defining an enclosed chamber and having a connected end and a remote end;

the connected end being adapted to permit the oil burner to direct a flame into the enclosed chamber; and a damper connected to the remote end of the sleeve, said damper being adapted to pivot relative the sleeve, the damper being provided with a counterbalancing weight, the said weight being adapted to vary the force required to pivot the damper relative to the sleeve;

whereby increased temperatures can be maintained in the enclosed chamber to assure complete combustion of hydrocarbons not burned by the oil burner.

13. The enclosure of claim 12 wherein the counterbalancing weight is adjustable relative to the damper.

14. A process for the clean combustion of fuel oil in an installation of the type wherein an oil burner is provided with a sleeve, one connected end of which is supported in proximity to the oil burner and the other remote end of which is equipped with a damper comprising burning fuel oil in the oil burner to produce a flame and a small percentage of unburned fuel oil particles;

directing the flame from the oil burner into the sleeve;

retaining some of the heat from the flame within the sleeve by utilizing the damper;

maintaining the temperature within the sleeve above that required for the automatic ignition of the fuel oil;

igniting automatically the unburned particles of fuel oil within the sleeve;

building up pressure within the sleeve during the burning of the fuel oil and mantaining constant the pressure by operation of the damper;

whereby fuel oil not fully ignited by the oil burner is automatically ignited within the sleeve to provide complete combustion of the fuel oil.

15. The process of claim 14 and preheating the sleeve to a temperature above that required for automatic ignition of the fuel oil prior to burning the fuel oil.

16. The process of claim 15 and utilizing a fuel other than fuel oil for the preheating.

17. The process of claim 16 wherein the fuel is gas.

18. The process of claim 14 and the additional step of admitting air into the sleeve at the connected end to provide induced air for burning of the fuel oil.

19. The process of claim 18 including the step of adjusting the quantity of air admitted into the sleeve.

* * * * *